United States Patent [19]

Niijima

[11] Patent Number: 4,724,991

[45] Date of Patent: Feb. 16, 1988

[54] APPARATUS FOR ADJUSTING DIRECTION OF TWO COMPONENT FASTENERS FOR ATTACHEMENT TO GARMENTS

[75] Inventor: Eisaku Niijima, Saitama, Japan

[73] Assignee: Morito Co., Ltd., Osaka, Japan

[21] Appl. No.: 938,624

[22] Filed: Dec. 4, 1986

[30] Foreign Application Priority Data

Jan. 10, 1986 [JP] Japan ..... 61-3907

[51] Int. Cl.[4] ..... B25C 5/10; B23P 19/04

[52] U.S. Cl. ..... 227/119; 29/789; 29/797; 29/717; 414/754; 414/779; 414/783

[58] Field of Search ..... 29/789, 788, 796, 797, 29/717, 714, 715, 809, 818; 227/119; 414/754, 779, 783

[56] References Cited

U.S. PATENT DOCUMENTS

| | | | |
|---|---|---|---|
| 4,007,537 | 2/1977 | Silverbush et al. | 227/119 |
| 4,019,666 | 4/1977 | Foults | 227/119 |
| 4,427,146 | 1/1984 | Seki | 227/119 |

*Primary Examiner*—Mark Rosenbaum
*Assistant Examiner*—Frances Chin
*Attorney, Agent, or Firm*—Trexler, Bushnell, Giangiorgi & Blackstone, Ltd.

[57] ABSTRACT

An apparatus for adjusting direction of two component fasteners having a head element and a backing element for attachment to garment. The apparatus is a reciprocable driving device (8) for receiving the head element (*7a*) fed in from a hopper feeder (4*a*) through a chute (5) and charging it into a clamping device (12). The apparatus comprises an interlocking mechanism for rotating a support seat (9) for the head element (*7a*) in synchronism with the reciprocating movement of the driving device (8), a stopper (56) for stopping the rotation of the head element (*7a*), and a stopper exchanging device. The stopper exchanging device is a head element pressing section (43) comprising two layers (49, 50). The upper layer (50) having the stopper (56) is rotatable relative to the lower layer (49).

4 Claims, 9 Drawing Figures

APPARATUS FOR ADJUSTING DIRECTION OF TWO COMPONENT FASTENERS FOR ATTACHEMENT TO GARMENTS

FIELD OF THE INVENTION AND RELATED ART STATEMENT

The present invention relates to an attaching machine used in attaching two component fasteners comprising a head element and a backing element to garments. More particularly, it relates to an apparatus for adjusting direction of the two component fasteners for attachment to garments, which is capable of positional adjustment of the head elements of the fasteners to direct them in the proper direction when they have directionality on their surfaces.

Two component fasteners such as snap fasteners, shank buttons, rivets or the like (hereinafter collectively referred to as the fastener or fasteners) usually have patterns or characters on their surfaces of the head elements. Thus, when they are to be attached to garments, it is desired from an aesthetic point of view that the positions, i.e., directions, of the patterns or characters coincide with each other or be symmetrical, so as to ensure general coordination.

To meet this need, there have been some techniques. The inventor of the present invention has also proposed a device in Japanese Patent Application Laid-Open No. 199803/1984. In brief, this device is a reciprocable driving device used for receiving head elements of the fasteners fed in from a hopper feeder through a chute and charging them into a clamping device, and is equipped with an interlocking mechanism for rotating a support seat for the head element in synchronism with the reciprocating movement. When the driving device is advanced, the support seat is rotated and so is the head element placed thereon. The head element is formed with a small notch in its back. When said notch is engaged by a stopper, the rotation of the head element is stopped though the support seat continues rotating. The head element of the fastener has its position thereby adjusted.

In this prior technique, a plurality of stoppers are prepared in advance for changing the stopper position, so that only a required stopper is depressed by a spring. Although this device is relatively simple, it is difficult to change the spring position since the spring is positioned in the innermost region which is hardly accessible.

As for another prior technique relating to the change of stopper position, there is an invention disclosed in Japanese Patent Publication No. 53881/1982 (corresponding to U.S. patent application Ser. No. 630,449), which requires a much more complicated mechanism than does the first-mentioned invention.

Further, in the aforesaid two inventions, the operator cannot see the face of the head element of the fastener during attaching operation since the head elements fed in are received with their faces placed on the lower support seat. Thus, there has been a disadvantage whether or not the stopper is set at the correct position which must be ascertained only by the method of trial and error.

OBJECTS AND SUMMARY OF THE INVENTION

An object of the invention is to provide a driving device so designed that the change of the stopper position is very easy.

Another object of the invention is to provide a driving device designed to allow the operator to see the faces of the head elements during the attaching operation.

The invention, which achieves the aforesaid objects, is a reciprocable driving device used for receiving head elements of the fasteners fed in from a hopper feeder through a chute and charging them into a clamping device, said driving device including an interlocking mechanism for rotating a support seat for the head elements in synchronism with the reciprocating movement, a stopper for stopping the rotation of the head element which rotates with the support seat, and means for changing the position of said stopper, said stopper position changing means being a head element pressing section formed in two layers, the upper layer, which has the stopper, being rotatable relative to the lower layer.

Preferably, the upper and lower layers of said head element pressing section have means for selectively stabilizing their positional relation.

Preferably, the driving device includes a sliding member slidable therein and having upper and lower portions for holding the head element therebetween with the face of the head element directed upward.

BRIEF DESCRIPTION OF THE DRAWINGS

An embodiment of the invention will now be described with reference to the accompanying drawings, in which.

DETAILED DESCRIPTION OF PREFERRED EMBODIMENT

Figure 1:
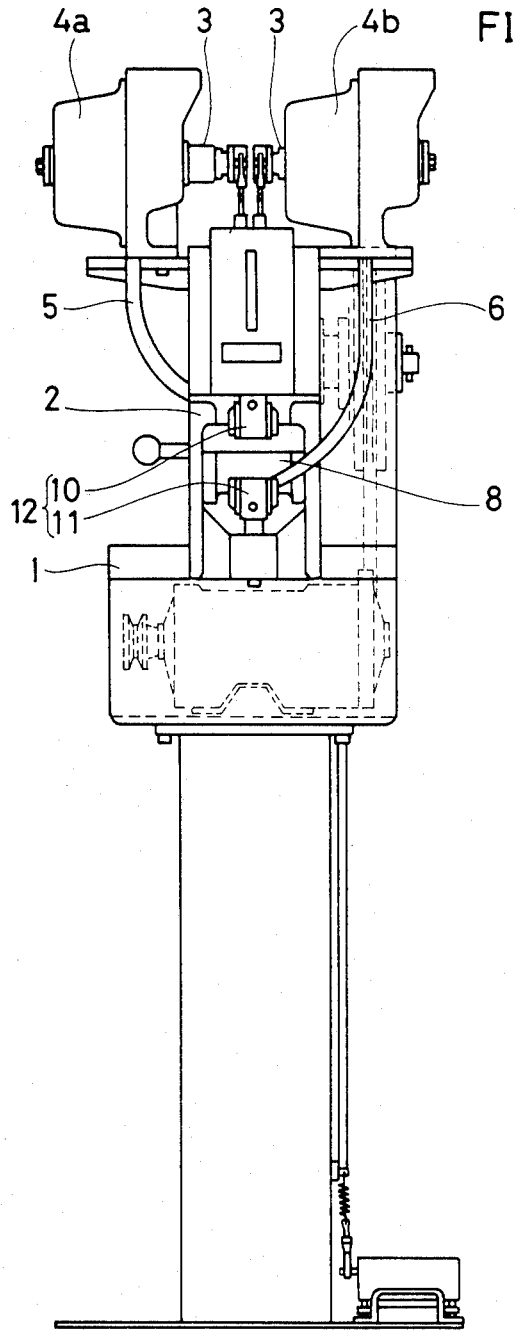
FIG. 1 is a front view of a fastener attaching machine.
Figure 2:
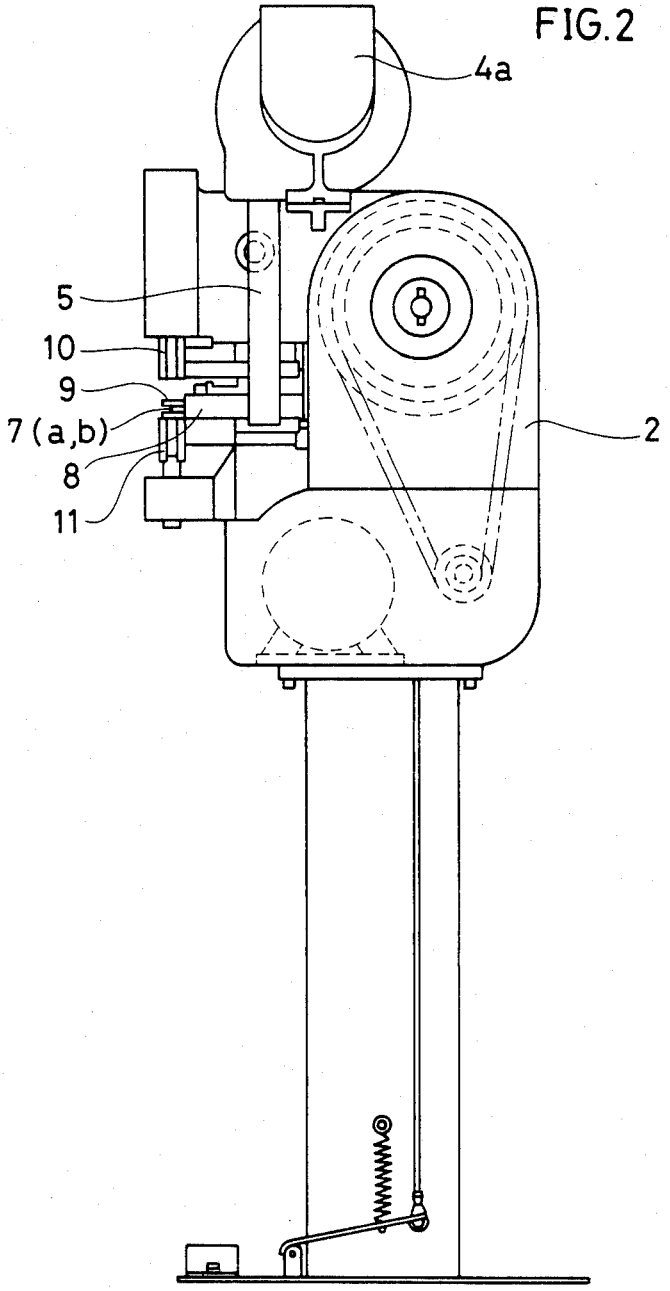
FIG. 2 is a side view of said machine.

In FIGS. 1 and 2, numeral 1 denotes a table and 2 denotes a frame fixed on said table. Hopper feeders 4*a* and 4*b* are attached to said table through arms 3. One hopper feeder 4*a* has the upper end of an upper chute 5 connected thereto while the other hopper feeder 4*b* has the upper end of a lower chute 6 connected thereto.

The head element 7*a* of the fastener fed in from the hopper feeder 4*a* through the upper chute 5 is placed on a support seat 9 disposed at the front end of a reciprocable driving device 8 and is advanced. At the most advanced position of the support seat 9, there is a clamping device 12 comprising upper and lower units 10 and 11 for chucking the head element 7*a* which is then combined with a backing element 7*b* which has been fed in through the lower chute 6, the two elements thus put together being clamped to a garment or the like. When the head element 7*a* is chucked, the driving device 8 begins to retract to be ready for the next operation.

The driving device 8 equipped with the head element position adjusting device which characterizes the present invention will now be described in more detail with reference to FIGS. 3 through 6.

Figure 3A:
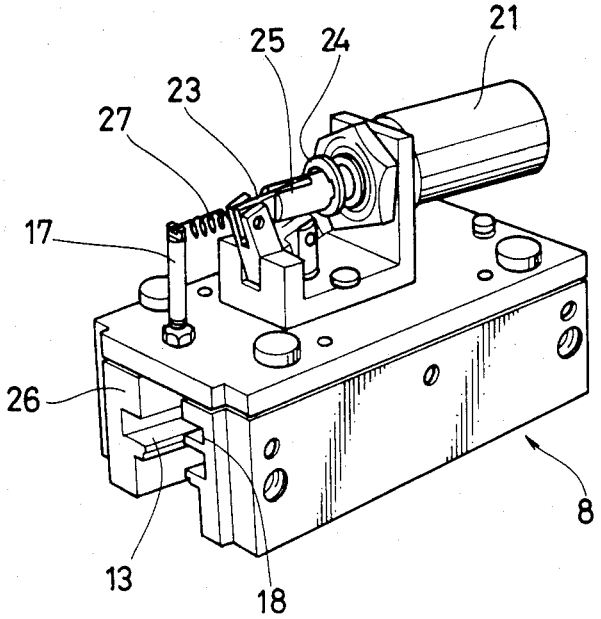
FIG. 3*a* is a perspective view of a driving device in its entirety according to the present invention.
Figure 3B:
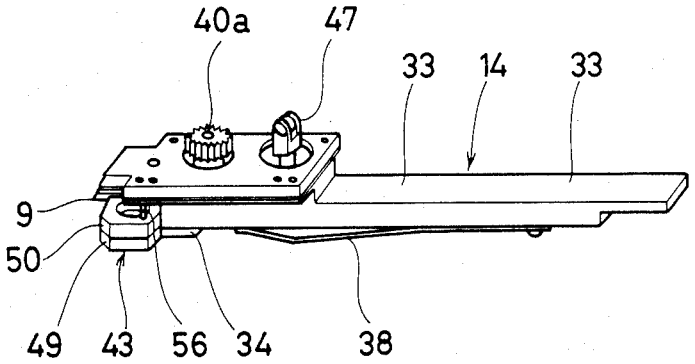
FIG. 3*b* is a perspective view of a sliding member slidable in the driving device.

FIG. 3*a* is a perspective view of the driving device 8 in its entirety, and FIG. 3*b* is a perspective view of a sliding member 14 slidable in a passage 13 formed in the driving device 8. The main portion of the driving device 8 is substantially the same as in aforesaid Japanese Patent Application Laid-Open No. 199803/1984 except that the upper and lower slides are reversed.

Figure 4A:
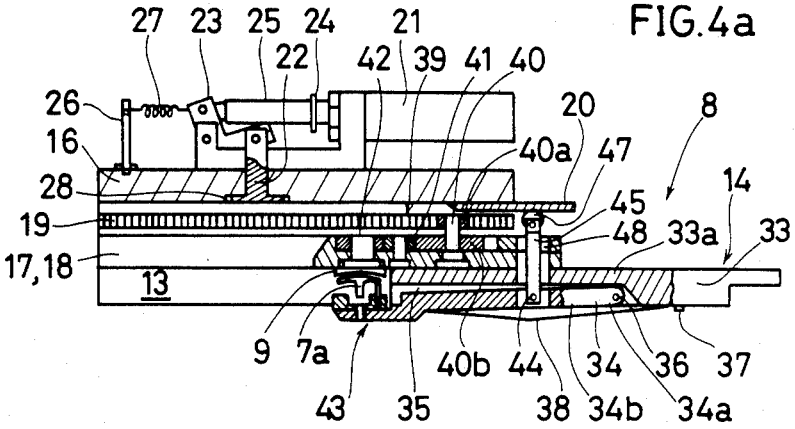
FIGS. 4*a* through 4*c* are sectional views showing the movement of the sliding member in the driving device.
Figure 4B:
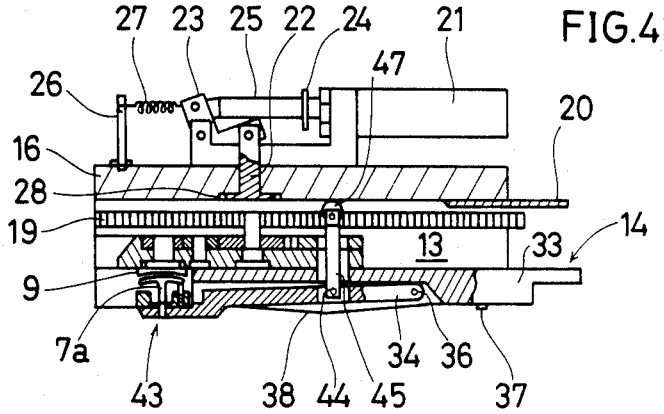
Figure 4C:
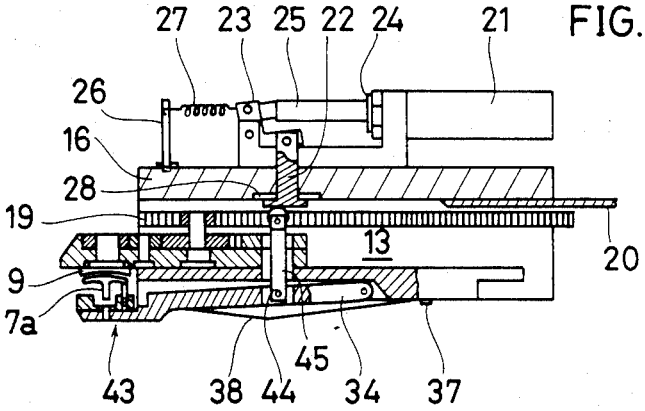

The movement of the sliding member 14 in the driving device 8 is shown in FIGS. 4*a* through 4*c*. FIG. 4*a* is a view in which the support seat 9 at the foremost end of the sliding member 14 is at a position for receiving the head element 7*a* fed in from the upper chute 5; FIG. 4*b* shows the sliding member 14 assuming a position during its travel through the passage 13; and FIG. 4*c* shows the support seat 9 most advanced to the clamping device 12.

In FIGS. 4*a* through 4*c*, the body 16 of the driving device 8 is provided with guide members 17 and 18, and these two guide members define said passage 13. The upper inner surface of one guide member 17 is provided with a rack 19. A plate cam 20 is attached to the rear of the central portion of the passage 13. Further, a movable cam 22 adapted to serve as a plate cam only when a solenoid 21 is energized is provided on the front of the central upper portion. The upper end of the movable cam 22 is connected to one end of a pivotally supported bell crank 23. The other end of the bell crank 23 is connected at its rear to a piston 25 having a flange 24 and at its front to a spring 27 supported by a fixed bar 26. When the solenoid is not energized, the bell crank 23 is forwardly tilted by the action of the spring 27, so that the movable cam 22 is lifted and received in a recess 28 in the passage 13 in the body. However, when the solenoid 21 is energized, it attracts the piston 25 until the flange 24 is stopped, so that the bell crank 23 is rearwardly tilted and hence the movable cam 22 is lowered to serve as a plate cam. FIG. 4*c* shows this state.

Figure 5:
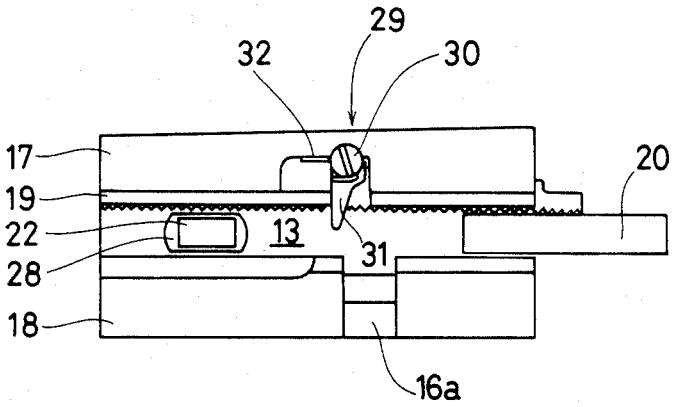
FIG. 5 is a bottom view of the driving device, with the sliding member omitted.

In the lowermost portion of the driving device and on the side associated with the passage 13, there is a head element tilt preventing device 29, as shown in FIG. 5. In the present invention, since the head element fed in from the upper chute 5 through an inlet port 16*a* is supported on the upper support seat with its face directed upward (in the form of an unfolded umbrella), it is necessary to temporarily prevent the head element from tilting. During travel through the passage, the head element is supported by the sliding member 14 so that it will not tilt, and during clamping operation it is supported by the chuck device; thus, this kind of device is not necessary. The head element tilt preventing device comprises a pawl 31 turnable around the axis of a shaft 30 and a spring 32 normally urging said pawl toward the passage 13. During the travel of the sliding member, since the pawl 31 is pressed toward the guide member 17 against the force of the spring 32, it does not interfere with the travel.

Referring again to FIGS. 4*a* through 4*c*, the sliding member 14 adapted to slide along the passage 13 comprises upper and lower portions 33 and 34. The slender body 33*a* of the upper portion 33 is formed with a relatively long groove 35, in which the lower portion 34 of the sliding member is received. The upper and lower portions 33 and 34 of the sliding member are slidable around the axis of a pin 36 installed in the terminal end 34*a* of the lower portion. Normally, the lower portion 34 is pressed toward the upper portion 33 by a plate spring 38 fixed at one place to the upper portion 33 of the sliding member by a pin 37.

The upper portion 33 of the sliding member comprises said slender body 33*a*, the support seat 9 provided at the foremost end of said body, and a support seat rotating mechanism 39. The support seat rotating mechanism 39 comprises a plurality of gear wheels. When the sliding member 14 is reciprocated, a two-layer gear wheel 40 fixed on the upper portion 33 is also reciprocated. Of the two layers, the upper layer gear wheel 40*a* meshes with the rack 19 provided in the passage 13 to rotate said two-layer gear wheel 40. The lower layer gear wheel 40*b* transmits its rotative force to first and second small gear wheels 41 and 42, said gear wheel 40*b* meshing with said gear wheel 41. Since the rotative shaft of the second small gear wheel 42 also forms the rotative shaft for the support seat 9, the support seat 9 is rotated.

The lower portion 34 of the sliding member comprises a slender body 34*b* and a head element pressing section 43 provided at the foremost end of the body 34*b*. The body 34*b* has a swing bar 45 fixed thereto at one end by a pin 44, the front end of said swing bar 45 having a roller 47 rotatably attached thereto. The swing bar 45 projects above the upper portion 33 through an opening 48 in the upper portion 33 of the sliding member. Only when the roller 47 comes in contact with said plate cam 20 and movable cam 22, the lower portion 34 of the sliding member is depressed against the force of the plate spring 38. When the roller 47 reaches the plate cam 20, the upper and lower portions 33 and 34 of the sliding member are opened, so that the head element fed in from the chute 5 is received between the support seat 9 and the head element pressing section 43 (see FIG. 4*a*). When the solenoid 21 is energized to lower the movable cam 22 and the roller 47 comes in contact therewith, the upper and lower portions 33 and 34 of the sliding member are also opened. Thereupon, the chuck mechanism of the clamping device 12 is actuated, whereby the head element is taken into the clamping device (see FIG. 4*c*).

Figure 6:
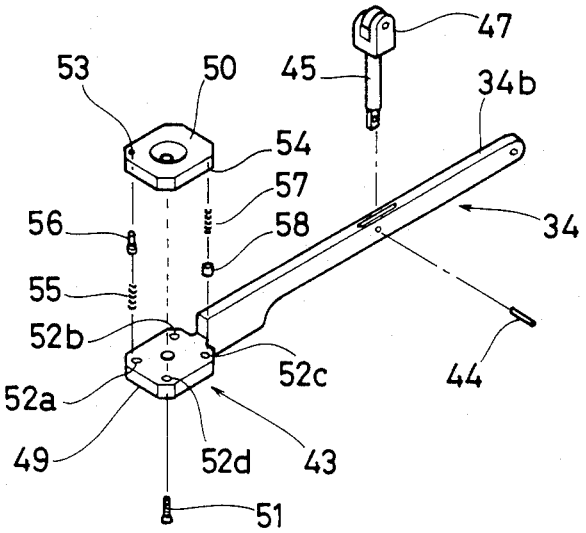
FIG. 6 is an exploded view of the head element pressing portion.

The head element pressing section 43 is one of the greatest features of the present invention, the detail thereof being shown in FIG. 6. This head element pressing section 43 comprises two layers. The lower layer 49 is integral with the body 34*b*. The upper layer 50 is rotatable since it is pivotally connected at its middle to the lower layer 49 by a pin 51. The lower layer 49 is formed at its four corners with small recesses 52 (a, b, c and d). The upper layer 50 is formed on its upper side with a small hole 53 and on its lower side with a small recess 54. The small hole 53 on the upper side receives a stopper 56 through a spring 55. The stopper 56 projects above the upper layer 50 and is vertically movable to some extent because of the spring 55, making it possible to firmly hold the head element. The small recess 54 on the lower side receives a small cap 58 through a spring 57. This small cap 58 is capable of a vertical movement because of the spring 57. When the small cap 58 is received in one of the small recesses 52*a* of the lower layer, the upper and lower layers 49 and 50 have their positional relation stabilized. This degree of stability is such that it is lost if the upper layer 50 is gripped by hand and fast rotated. When the upper layer is kept rotating until the other small recess 52*b* of the lower layer 49 is reached, said small cap is received in said small recess 52b, whereby stability is restored. Thus, in this embodiment, the positional relation between the upper and lower layers 49 and 50 is stabilized at four places. In other words, the position of the stopper 56 projecting above the upper layer 50 can be changed in four directions by simple manual operation. As for this stopper 56 engaging the notch formed in the back of the head element, the technique is the same as in the prior art.

In addition, the mechanism for advancing and retracting the driving device, the mechanism for energizing and deenergizing the solenoid in accordance with the travel of the driving device, and the mechanism for chucking and clamping the head element are substantially the same as in the prior art mentioned at the outset, or for that matter, the type of machine marketed by Morito Co., Ltd., Osaka, Japan as a Model No. APM-201, and since they are not essential portions of the invention, a description thereof is omitted.

The terms and expressions which have been employed in the foregoing description are used as terms of description and not of limitation, and there is no intention, in the use of such terms and expressions, of excluding any equivalents of the feature shown and described or portions thereof, but it is recognized that various modifications are possible within the scope of the invention claimed.

What is claimed is:

1. An apparatus for adjusting direction of two component fasteners having a head element and a backing element for attachment to garments which is in the form of a reciprocable driving device for receiving the head element fed in from a hopper feeder through a chute and charging said head element into a clamping device, said driving device comprising an interlocking mechanism for rotating a support seat for the head element in synchronism with the reciprocating movement of said driving device, a stopper for stopping the rotation of the head element which rotates with the support seat, and means for changing the position of said stopper, said stopper position changing means being in the form of a head element pressing section comprising two layers, of which the upper layer having the stopper is rotatable relative to the lower layer.

2. An apparatus as set forth in claim 1, further including means for selectively stabilizing the positional relation between the upper and lower layers of the two-layer head element pressing section.

3. An apparatus as set forth in claim 2, wherein the means for selectively stabilizing the positional relation between the upper and lower layers of the two-layer head element pressing section comprises a small cap equipped with a spring on one side and a plurality of small recesses on the other side for engagement with said small cap.

4. An apparatus as set forth in claim 1, wherein said driving device has a sliding member slidable therein, said sliding member comprising upper and lower portions for holding the head element therebetween with the face of the head element directed upward.

* * * * *